US009113250B2

(12) United States Patent
Huang

(10) Patent No.: US 9,113,250 B2
(45) Date of Patent: Aug. 18, 2015

(54) SPEAKER WITH DIAPHRAGM ARRANGEMENT

(71) Applicant: Hsin Min Huang, Ningbo (CN)

(72) Inventor: Hsin Min Huang, Ningbo (CN)

(73) Assignee: TANG BAND INDUSTRIES CO., LTD., Ningbo, Zhejiang (CN)

( * ) Notice: Subject to any disclaimer, the term of this patent is extended or adjusted under 35 U.S.C. 154(b) by 3 days.

(21) Appl. No.: 13/905,103

(22) Filed: May 29, 2013

(65) Prior Publication Data

US 2014/0355813 A1 Dec. 4, 2014

(51) Int. Cl.

| | |
|---|---|
| ***H04R 7/10*** | (2006.01) |
| ***H04R 7/02*** | (2006.01) |
| ***H04R 31/00*** | (2006.01) |
| ***H04R 7/06*** | (2006.01) |
| ***H04R 7/04*** | (2006.01) |

(52) U.S. Cl.

CPC .. *H04R 7/10* (2013.01); *H04R 7/02* (2013.01); *H04R 7/04* (2013.01); *H04R 7/06* (2013.01); *H04R 31/003* (2013.01); *H04R 2307/021* (2013.01); *H04R 2307/025* (2013.01); *H04R 2307/027* (2013.01); *H04R 2307/029* (2013.01)

(58) Field of Classification Search

CPC ..... H04R 7/02; H04R 7/04; H04R 7/045; H04R 7/06; H04R 7/10; H04R 7/12; H04R 7/122; H04R 7/125; H04R 2307/021; H04R 2307/025; H04R 2307/027; H04R 2307/029

USPC ..... 381/423, 424, 426, 427, 428, 431, 398, 381/191, 152; 181/157, 167–170; 29/594, 29/609.1

See application file for complete search history.

(56) References Cited

U.S. PATENT DOCUMENTS

| | | | | |
|---|---|---|---|---|
| 4,122,314 | A * | 10/1978 | Matsuda et al. | 381/425 |
| 4,517,416 | A * | 5/1985 | Goossens | 381/431 |
| 5,259,036 | A * | 11/1993 | Seeler | 381/426 |
| 6,030,561 | A * | 2/2000 | Sato et al. | 264/51 |
| 6,097,829 | A * | 8/2000 | Guenther et al. | 381/425 |
| 6,404,897 | B1 * | 6/2002 | Devantier et al. | 381/426 |
| 6,453,049 | B1 * | 9/2002 | Chu et al. | 381/152 |
| 7,092,544 | B2 * | 8/2006 | Hachiya et al. | 381/426 |
| 7,236,601 | B1 * | 6/2007 | Bachmann et al. | 381/152 |
| 7,344,001 | B2 * | 3/2008 | Inoue et al. | 181/169 |
| 7,631,723 | B2 * | 12/2009 | Ono et al. | 181/169 |
| 7,644,801 | B2 * | 1/2010 | Klein et al. | 181/157 |
| 8,068,635 | B2 * | 11/2011 | Carlson et al. | 381/426 |
| 8,131,001 | B2 * | 3/2012 | Toyofuku et al. | 381/398 |
| 2001/0006131 | A1 * | 7/2001 | Bream | 181/167 |
| 2002/0094095 | A1 * | 7/2002 | Ellis et al. | 381/152 |
| 2003/0021436 | A1 * | 1/2003 | Wu | 381/426 |
| 2004/0112672 | A1 * | 6/2004 | Ono et al. | 181/169 |
| 2005/0211499 | A1 * | 9/2005 | Schwarzenberg et al. | 181/167 |
| 2006/0222202 | A1 * | 10/2006 | Uryu et al. | 381/426 |
| 2006/0266577 | A1 * | 11/2006 | Inoue et al. | 181/167 |
| 2007/0286448 | A1 * | 12/2007 | Sato | 381/424 |
| 2010/0288579 | A1 * | 11/2010 | Gerkinsmeyer | 181/169 |
| 2014/0098984 | A1 * | 4/2014 | Werners et al. | 381/423 |

* cited by examiner

*Primary Examiner* — Curtis Kuntz
*Assistant Examiner* — Joshua A Kaufman
(74) *Attorney, Agent, or Firm* — Raymond Y. Chan; David and Raymond Patent Firm

(57) ABSTRACT

A diaphragm arrangement includes a middle foaming layer defining a first flat surface and an opposed flat surface, a first layer overlapped on the first flat surface of the middle foaming layer, and a second layer overlapped on the second flat surface of the middle foaming layer to form a flat speaker diaphragm which is arranged to mount at an opening of a supporting frame of a speaker.

14 Claims, 3 Drawing Sheets

SPEAKER WITH DIAPHRAGM ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a speaker, and more particular to a speaker with a diaphragm arrangement which comprises a middle foaming layer being sandwiched between a first layer and a second layer for simplifying the structural configuration of the diaphragm arrangement and for substantially reducing the manufacturing process of the diaphragm arrangement to incorporate with the speaker.

2. Description of Related Arts

A conventional speaker generally comprises a speaker frame, a voice coil, and a diaphragm to reproduce the voice coil signal from the voice coil. The conventional diaphragm comprises a middle layer sandwiched between two covering layers, wherein the middle layer is made paper or aluminum with a beehive-shaped structure as shown in FIG. 1. The purpose of the diaphragm is to accurately transform the voice coil signal waveform from the voice coil to an audio sound. Inaccurate reproduction of the voice coil signal results in acoustical distortion. The main parameter of diaphragm is Fo value illustrating the amplitude of vibration of the diaphragm. The major characteristics of the diaphragm are light weight and high elasticity coefficient. The stiffness and damping of the diaphragm play a crucial role in accuracy of the reproduced voice coil signal. However, the conventional diaphragm has several drawbacks.

Due to the beehive-shaped middle layer, the surfaces of the middle layer are not two flat surfaces. Therefore, the manufacturing process of the diaphragm requires special equipment to attach the middle layer between the two covering layers. In addition, due to the uneven surfaces of the middle layer, the manufacturing process of the diaphragm is very complicated that the defect rate of the diaphragm is relatively high, especially when the diaphragm is made of aluminum.

In order to reduce the defect rate of the diaphragm during the manufacturing process, the middle layer can be made of synthetic fiber, such as aramid fiber. However, the cost of the synthetic fiber made middle layer is relatively high such that the manufacturing cost of the diaphragm will be substantially increased. Although the middle layer can be made by paper to reduce the cost of the diaphragm, the paper made middle layer is lack of rigidity to reduce the quality of the beehive-shaped structure of the middle layer for the diaphragm.

Since the beehive-shaped middle layer defines a plurality of chambers on each uneven surface, it is impossible to apply adhesive evenly on the uneven surfaces of the middle layer to attach the covering layers onto the uneven surfaces of the middle layer. In other words, the surface contacting areas between the uneven surface of the middle layer and the covering layer will be minimized by the beehive-structure of the middle layer. As a result, the covering layers cannot be securely glued on the uneven surfaces of the middle layer to form the diaphragm. Furthermore, when the adhesive is applied on the uneven surfaces of the middle layer, the adhesive will unavoidably fill into the chambers of the middle layer. Once the chambers are filled by the adhesive, the adhesive cannot be removed from the chambers. Therefore, the elasticity of the diaphragm will be substantially reduced by the adhesive being filled into the chambers. In other words, the conventional method for manufacturing the diaphragm has a low yield and requires special equipments and special adhesive.

SUMMARY OF THE PRESENT INVENTION

The invention is advantageous in that it provides a speaker with a diaphragm arrangement which comprises a middle foaming layer being sandwiched between a first layer and a second layer for simplifying the structural configuration of the diaphragm arrangement and for substantially reducing the manufacturing process of the diaphragm arrangement to incorporate with the speaker.

Another advantage of the invention is to provide the diaphragm arrangement, wherein the middle foaming layer has two flat surfaces to attach the first and second layers so as to increase the contacting surface areas between the flat surfaces of the middle foaming layer and the first and second layers.

Another advantage of the invention is to provide the diaphragm arrangement, wherein adhesive can be evenly and easily applied on the flat surfaces of the middle foaming layer to attach the first and second layers so as to simplify the manufacturing process to attach the middle foaming layer between the first and second layers.

Another advantage of the invention is to provide the diaphragm arrangement, wherein the middle foaming layer is made of foamed polypropylene material being sandwiched between the first and second layers.

Another advantage of the invention is to provide the diaphragm arrangement which is a flat speaker diaphragm with a planar configuration.

Another advantage of the invention is to provide the diaphragm arrangement, wherein the middle layer made by injection to simplify the manufacturing process of the middle layer to form the speaker diaphragm.

Another advantage of the invention is to provide the diaphragm arrangement, wherein the first and second layers can be made by different materials to sandwich the middle layer depending the use of the speaker diaphragm.

Another advantage of the invention is to provide the diaphragm arrangement, which does not require to alter the original structural design of the speaker diaphragm, so as to minimize the manufacturing cost of the speaker incorporating with the diaphragm arrangement.

Another advantage of the invention is to provide the diaphragm arrangement, wherein no expensive or complicated structure is required to employ in the present invention in order to achieve the above mentioned objects. Therefore, the present invention successfully provides an economic and efficient solution for providing a high quality of diaphragm arrangement for the speaker in low manufacturing cost and for minimizing the defect rate of the speaker diaphragm during the manufacturing process thereof.

Additional advantages and features of the invention will become apparent from the description which follows, and may be realized by means of the instrumentalities and combinations particular point out in the appended claims.

According to the present invention, the foregoing and other objects and advantages are attained by a speaker which comprises a supporting frame, an electromagnetic provider, and a diaphragm arrangement supported at an opening of the supporting frame for receiving a vibration force generated from the electromagnetic provider. The diaphragm arrangement comprises a middle foaming layer defining a first flat surface and an opposed flat surface, a first layer overlapped on the first flat surface of the middle foaming layer, and a second layer overlapped on the second flat surface of the middle foaming layer to form a flat speaker diaphragm.

In accordance with another aspect of the invention, the present invention comprises a diaphragm arrangement for a speaker, comprising: a middle foaming layer defining a first flat surface and an opposed flat surface, a first layer overlapped on the first flat surface of the middle foaming layer, and a second layer overlapped on the second flat surface of the middle foaming layer to form a flat speaker diaphragm.

In accordance with another aspect of the invention, the present invention comprises a manufacturing method of a diaphragm arrangement for a speaker, comprising the steps of:

(a) mold injecting a raw material to form a middle foaming layer having a first flat surface and an opposed flat surface:

(b) sandwiching the middle foaming layer between first and second layers at a position that the first layer is overlapped on the first flat surface of the middle foaming layer and the second layer is overlapped on the second flat surface of the middle foaming layer to form a flat speaker diaphragm.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
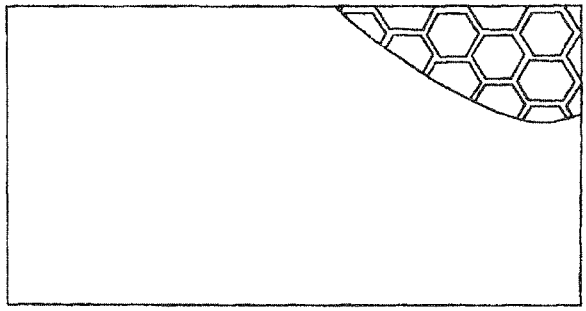
FIG.1 PRIOR ART
FIG. 1 illustrates a beehive-shaped middle layer of the diaphragm for a conventional speaker.
Figure 2:
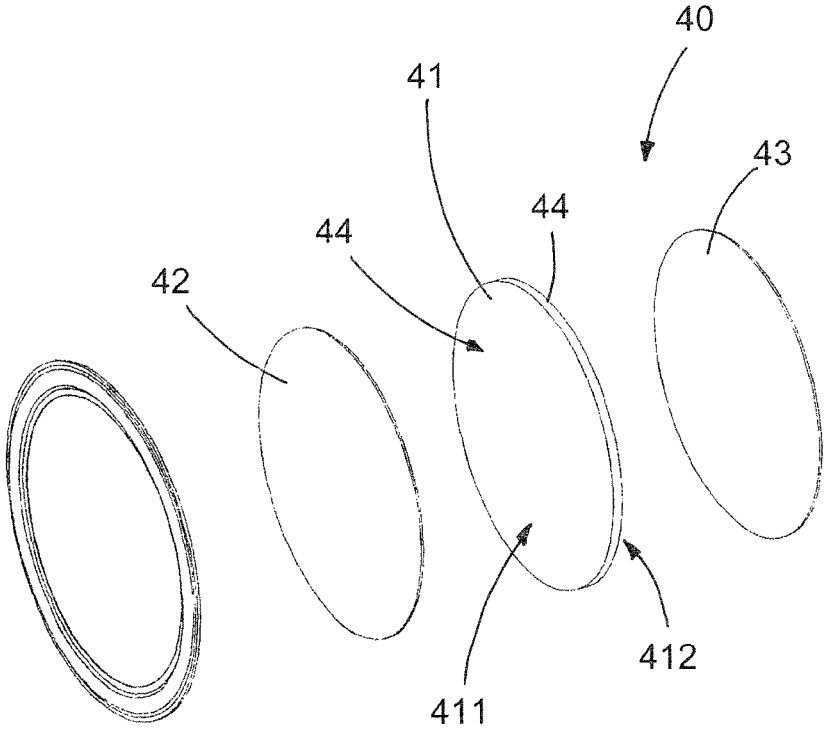
FIG. 2 is an exploded perspective view of a speaker with a diaphragm arrangement according to a preferred embodiment of the present invention.
Figure 3:
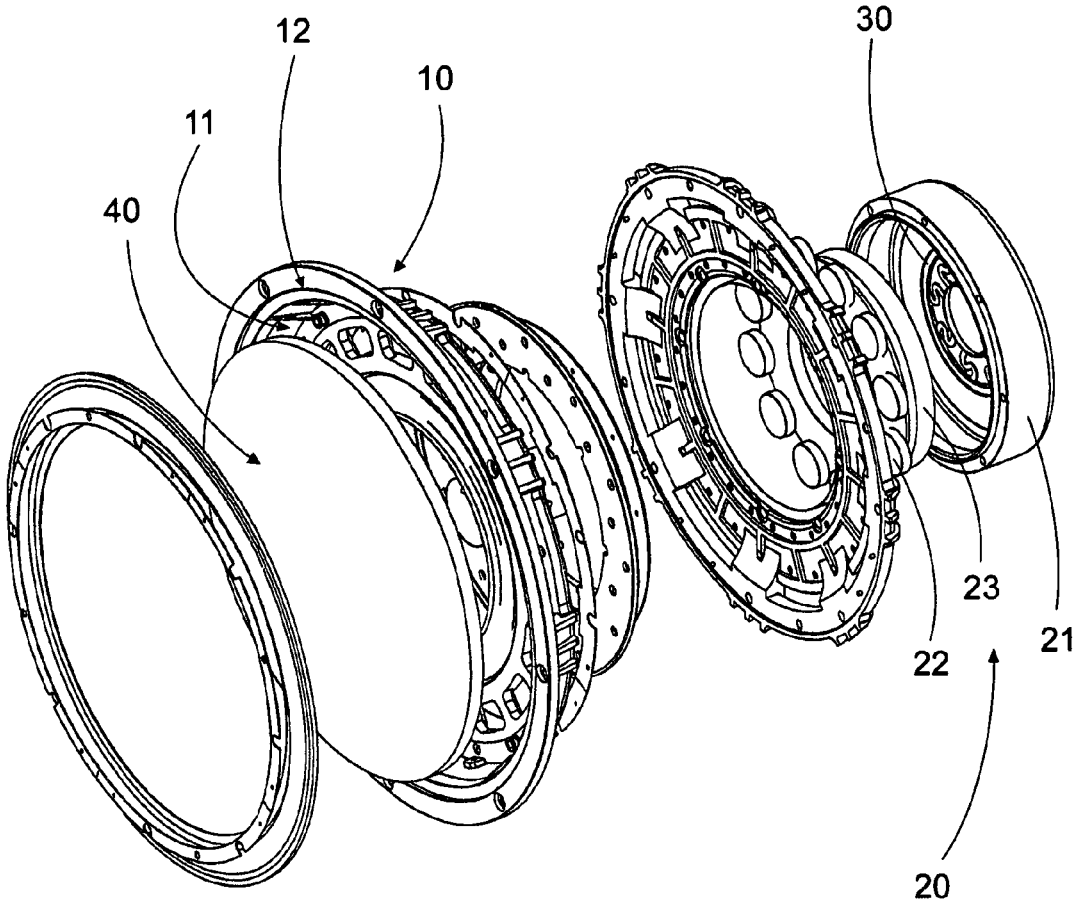
FIG. 3 is an exploded perspective view of the diaphragm arrangement according to the above preferred embodiment of the present invention.

Referring to FIGS. 2 and 3 of the drawings, speaker according to a preferred embodiment of the present invention is illustrated, wherein the speaker, such as an electromagnetic vibrator, comprises a supporting frame 10, an electromagnetic provider 20 supported by the supporting frame 10, a spider arrangement 30, and a diaphragm arrangement 40.

The supporting frame 10 has a receiving chamber 11 and an opening 12 coaxially aligning with the receiving chamber 11, wherein the electromagnetic provider 20 is movably supported in the receiving chamber 11.

The electromagnetic provider 20 comprises a base frame 21 coupling with the supporting frame 10, and a magnetic element 22 supported within the base frame 21, an induction coil 23 supported within the supporting frame 10 to electromagnetically communicate with the magnetic element 22, wherein when a current passes through the induction coil 23, the induction coil 23 is inducted with respect to the magnetic field, in such a manner that the induction coil 23 is driven to move in an axially movable manner so as to generate a vibration force at the diaphragm arrangement 40.

Accordingly, The induction coil 23, which is provided to an inner side of the diaphragm arrangement 40, comprises a coil body and a coil wire winding around the coil body and arranged in such a manner that when the current passes through the coil wire, the induction coil 23 is electromagnetically inducted with the magnetic field of the electromagnetic provider 20 to drive the induction coil 23 move in an axially movable manner so as to generate a vibration force at the diaphragm arrangement 40. The diaphragm arrangement 40 will transform the voice coil signal waveform from the electromagnetic provider 20 to an audio sound.

The spider arrangement 30 comprises an outer rim arranged for mounting to the supporting frame 10 and an inner rim coaxially aligning with the outer rim for mounting to the induction coil 23, wherein the inner rim of the spider arrangement 30 is driven to move axially in response to an electromagnetic force between the induction coil 23 and the magnetic element 22 so as to allow the induction coil 23 to alignedly move in a pistonic motion with respect to the magnetic element 22 in a stable manner.

According to the preferred embodiment, the diaphragm arrangement 40 is supported at the opening of the supporting frame 10, wherein the induction coil 23 is supported within the supporting frame 10 at a rear side of the diaphragm arrangement 40 in an axially movable manner.

The diaphragm arrangement 40 comprises a middle foaming layer 41, a first layer 42 and a second layer 43, wherein the middle foaming layer 41 is sandwiched between the first and second layers 42, 43 to form a flat speaker diaphragm in a planar configuration. In other words, the diaphragm arrangement 40 is laid flat at the opening of the supporting frame 10.

As shown in FIG. 2, the middle foaming layer 41 is made of foamed polypropylene material, and defines a first flat surface 411 overlapped and contacted with the first layer 42 and an opposed second flat surface 412 overlapped and contacted with the second layer 43. Therefore, the diaphragm arrangement 40 is constructed by multiple layers being stacked and overlapped to form the flat speaker diaphragm.

Accordingly, the middle foaming layer 41 is made by mold injection. In order to manufacture the middle foaming layer 41, a foaming piece is pre-formed by the mold injection. Then, the middle foaming layer 41 is formed, preferably in circular shape, by cutting the foaming piece into a predetermined size and shape. In other words, the middle foaming layer 41 can be configured in different sizes and shapes through the cutting and trimming process of the foaming piece. Therefore, the foaming piece can be cut in any diameter matching with the opening of the supporting frame 10.

It is worth mentioning that after the middle foaming layer 41 is made by mold injection, the middle foaming layer 41 has two flat and smooth surfaces, i.e. the first and second flat surfaces 411, 412. Therefore, when the middle foaming layer 41 is sandwiched between the first and second layers 42, 43, the contacting surface areas between the first and second flat surfaces 411, 412 of the middle foaming layer 41 and the first and second layers 42, 43 will be maximized.

In addition, the thickness of the middle foaming layer 41 is larger than the thickness of each of the first and second layers 42, 43. In particular, the thickness of the middle foaming layer 41 can be selectively adjusted through the mold injection process.

The first and second layers 42, 43 can be made of different materials to form the flat speaker diaphragm depending on the requirement of the speaker. For example, when the first and second layers 42, 43 are made of rigid material, such as metal layer, the flat speaker diaphragm is designed for the tweeter or a midrange speaker. When the first and second layers 42, 43 are made of paper or fiber, the flat speaker diaphragm is designed for the midrange speaker or the woofer. It is worth mentioning that the middle foaming layer 41 is entirely covered between the first and second layers 42, 43. In addition, the first and second layers 42, 43 can be made of Kraft paper. Alternatively, the first and second layers 42, 43 can be made of thin metal film such as aluminum film or Titanium film. The first and second layers 42, 43 can be also made of braided fabric material such as non-woven fabric or plain weaving fabric.

In order to secure the attachment among the middle foaming layer 41, and the first and second layers 42, 43, the diaphragm arrangement 40 further comprises two adhering films 44, wherein one of the adhering films 44 is applied between the first flat surface 411 of the middle foaming layer 41 and the first layer 42 while another adhering film 44 is applied between the second flat surface 412 of the middle foaming layer 41 and the second layer 43. Accordingly, the adhering films 44 are made of one or more anaerobic adhesive. It is worth mentioning that since the first and second surfaces 411, 412 of the middle foaming layer 41 are two flat surfaces, the adhering films 44 can be easily formed thereon by any method such as spraying or coating to evenly apply the adhering films 44 on the first and second surfaces 411, 412 of the middle foaming layer 41.

Figure 4:
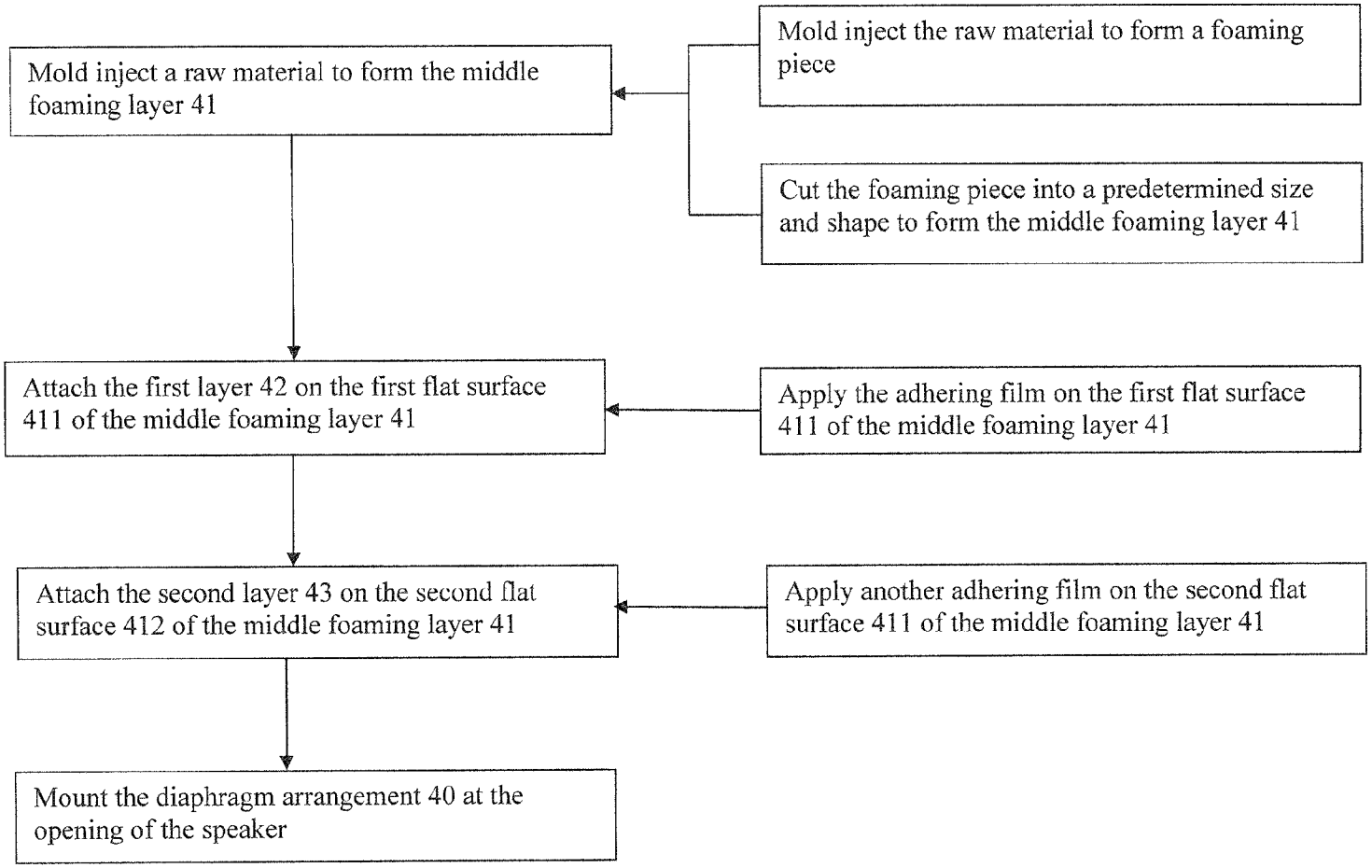
FIG. 4 illustrates a manufacturing process of the diaphragm arrangement according to the above preferred embodiment of the present invention.

As shown in FIG. 4, the present invention further provides a manufacturing method of the speaker diaphragm which comprises the following steps.

(1) Mold inject a raw material, which is polypropylene material, to form the middle foaming layer 41. In other words, the middle foaming layer 41 is formed by mold injection.

(2) Sandwich the middle foaming layer 41 between the first and second layers 42, 43 to form the flat speaker diaphragm.

According to the preferred embodiment, the foaming piece is pre-formed by the mold injection in the step (1). Then, the foaming piece is cut into a predetermined diameter to form the middle foaming layer 41, which matches with the diameter of the opening of the supporting frame 10.

The step (2) further comprises the step of applying the adhering films 44 to securely adhere the middle foaming layer 41 between the first and second layers 42, 43. Preferably, the adhering films 44 are evenly applied on the first and second flat surfaces 411, 412 of the middle foaming layer 41 respectively by spraying or coating. Accordingly, the adhesive used to form the adhering film 44 can be any adhering agent which is an environmental friendly product and has high thermal resistance and strong bonding ability.

It is worth mentioning that the polypropylene material used to form the middle foaming layer 41 has several advantages. It has high thermal resistance, wherein the thermal resistance of the diaphragm arrangement 40 is up to 120° C. It also has high resistance capacity to shock load, wherein during the vibration of the diaphragm arrangement 40, the middle foaming layer 41 can absorb the vibration force to enhance the performance of the diaphragm arrangement 40. In fact, the resistance capacity of the middle foaming layer 41 is better than that of the conventional beehive-shaped middle layer. The rigidity of the diaphragm arrangement 40 can be selectively adjusted via the first and second layers 42, 43. When the first and second layers 42, 43 are two rigid layers, the rigidity of the diaphragm arrangement 40 will be adjustably increased. Likewise, when the first and second layers 42, 43 are two soft layers, the rigidity of the diaphragm arrangement 40 will be adjustably reduced. The middle foaming layer 41 is relatively light to substantially reduce the overall weight of the diaphragm arrangement 40. The cost of each of the middle foaming layer 41 and the first and second layers 42, 43 is relatively low to further reduce the overall cost of the diaphragm arrangement 40. In addition, the adhering films 44 can be simply applied to the middle foaming layer 41 in order to reduce the manufacturing cost and to simplify the manufacturing process of the diaphragm arrangement 40.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A speaker, comprising:

a supporting frame having a receiving chamber and an opening;

an electromagnetic provider supported in said receiving chamber; and a diaphragm arrangement supported at said opening of said supporting frame for receiving a vibration force generated from said electromagnetic provider, wherein said diaphragm arrangement comprises:

a middle foaming layer, which is made of polypropylene material, having a first flat surface and an opposed flat surface that said first flat surface and said second flat surface are two smooth surfaces respectively, wherein said middle foaming layer is a mold-injected foaming layer that a thickness of said middle foaming layer is selectively adjusted through a mold injection process and a diameter of said middle foaming layer is configured to match with said opening of said supporting frame;

a first layer overlapped on said first flat surface of said middle foaming layer;

a second layer overlapped on said second flat surface of said middle foaming layer; and two adhering films evenly applied on said first flat surface and said second flat surface of said middle foaming layer respectively to securely attach said first layer and said second layer on said first flat surface and said second flat surface of said middle foaming layer respectively, so as to form a flat speaker diaphragm in a planar configuration.

2. The speaker, as recited in claim 1, wherein said adhering films are anaerobic adhesive.

3. The speaker, as recited in claim 2, wherein said first and second layers are made of thin metal film to be affixed on said first flat surface and said second flat surface of said middle foaming layer respectively.

4. The speaker, as recited in claim 2, wherein said first and second layers are made of material selected from the group consisting of paper and fiber.

5. The speaker, as recited in claim 1, wherein said first and second layers are made of thin metal film to be affixed on said first flat surface and said second flat surface of said middle foaming layer respectively.

6. The speaker, as recited in claim 1, wherein said first and second layers are made of material selected from the group consisting of paper and fiber.

7. The speaker, as recited in claim 1, wherein said first and second layers are made of different materials.

8. A diaphragm arrangement for a speaker which comprises a supporting frame and an electromagnetic provider, wherein said diaphragm arrangement is arranged for being supported at an opening of said supporting frame to receive a vibration force generated from said electromagnetic provider, wherein said diaphragm arrangement comprises:

a middle foaming layer, which is made of polypropylene material, having a first flat surface and an opposed flat surface that said first flat surface and said second flat surface are two smooth surfaces respectively, wherein said middle foaming layer is a mold-injected foaming layer that a thickness of said middle foaming layer is selectively adjusted through a mold injection process and a diameter of said middle foaming layer is configured for matching with said opening of said supporting frame;

a first layer overlapped on said first flat surface of said middle foaming layer;

a second layer overlapped on said second flat surface of said middle foaming layer; and two adhering films evenly applied on said first flat surface and said second flat surface of said middle foaming layer respectively to securely attach said first layer and said second layer on said first flat surface and said second flat surface of said middle foaming layer respectively, so as to form a flat speaker diaphragm in a planar configuration.

9. The diaphragm arrangement, as recited in claim 8, wherein said adhering films are anaerobic adhesive.

10. The diaphragm arrangement, as recited in claim 9, wherein said first and second layers are made of thin metal film to be affixed on said first flat surface and said second flat surface of said middle foaming layer respectively.

11. The diaphragm arrangement, as recited in claim 9, wherein said first and second layers are made of material selected from the group consisting of paper and fiber.

12. The diaphragm arrangement, as recited in claim 8, wherein said first and second layers are made of thin metal film to be affixed on said first flat surface and said second flat surface of said middle foaming layer respectively.

13. The diaphragm arrangement, as recited in claim 8, wherein said first and second layers are made of material selected from the group consisting of paper and fiber.

14. The diaphragm arrangement, as recited in claim 8, wherein said first and second layers are made of different materials.

* * * * *